United States Patent [19]

Aber

[11] 4,181,224

[45] Jan. 1, 1980

[54] APPARATUS FOR HOLDING PIERCED EARRINGS FOR DISPLAY AND/OR STORAGE

[76] Inventor: Dick S. Aber, 3219 S. Holly St., Denver, Colo. 80222

[21] Appl. No.: 21,762

[22] Filed: Mar. 19, 1979

[51] Int. Cl.[2] ..... B65D 85/58

[52] U.S. Cl. ..... 206/486; 206/45.14; 206/45.19; 206/566; 211/13

[58] Field of Search ..... 206/566, 486, 45.14, 206/45.19, 569, 487; 229/3.5 R; 223/109 R; 312/73; 211/13

[56] References Cited

U.S. PATENT DOCUMENTS

| | | | |
|---|---|---|---|
| 2,797,806 | 7/1957 | Davis | 206/486 |
| 3,066,847 | 12/1962 | Fortune | 229/3.5 R |
| 3,858,718 | 1/1975 | Roy | 206/45.19 |
| 4,043,449 | 8/1977 | Love | 206/45.14 |
| 4,099,611 | 7/1978 | Feibelman | 206/487 |

*Primary Examiner*—William T. Dixson, Jr.
*Attorney, Agent, or Firm*—Dennis K. Shelton

[57] ABSTRACT

Apparatus for holding pierced earrings for display and/or storage comprising a base and retention means on the base for removably retaining at least one pierced earring on the apparatus, the retention means having at least two layers of sheet plastic material overlaying the base, and at least two layers of filler material interposed between the two layers of sheet plastic material and between the base and one of the layers of sheet plastic material, respectively, the layers of sheet plastic material having a plurality of holes therethrough with each hole in the inner layer of sheet plastic material being located in direct axial alignment with a corresponding hole in the outer layer of sheet plastic material.

2 Claims, 9 Drawing Figures

APPARATUS FOR HOLDING PIERCED EARRINGS FOR DISPLAY AND/OR STORAGE

BACKGROUND OF THE INVENTION

1. Field of the Invention

This invention relates to apparatus for holding articles for display and/or storage, and more particularly relates to apparatus for displaying and/or storing relatively small articles having a decorative portion and at least one relatively small diameter shaft portion, e.g. pierced earrings and the like. The subject matter of this invention relates to the subject matter of my prior U.S. patent application Ser. No. 792,143 filed Apr. 29, 1977, now abandoned.

2. Description of the Prior Art

Various types of devices have been known for displaying jewelry and other items, both for home use and for commercial merchandising display. For example, U.S. Pat. No. 2,861,682 of Hatcher discloses a jewelry holding and display device having a plurality of blocks made of sponge rubber or plastic foam having a separate or integral decorative covering material arranged in side-by-side relation to provide slots between the blocks for receiving articles of jewelry. U.S. Pat. No. 2,962,156 of Adams discloses a portable jewelry case having a rotatable drum provided with longitudinally extending pockets or slots adapted to receive jewelry, especially finger rings. Other devices for holding and/or displaying various articles are illustrated by various U.S. Pat. Nos., including: 3,693,806 of Lit et al.; 1,555,719 of Scudero; 2,559,298 of Eisen et al.; 2,663,527 of Joslyn; 2,750,651 of Saito; 1,830,828 of Eaton; 2,463,644 of Reid; and 2,511,730 of McClain.

The foregoing devices, while adequate for storing or displaying articles of jewelry having relatively large protuberances, such as cuff links, finger rings and other unrelated articles, are generally inadequate for storing or displaying pierced earrings having decorative portions and relatively small diameter shaft portions, since the shaft portions of such articles are generally too small to be effectively clamped by the resilient walls of the slots or pockets, or the other holding means, illustrated in those patents.

It has now been found that the foregoing problems can be overcome and pierced earrings, or the like, having a decorative portion and a relatively small diameter straight shaft portion can be conveniently and easily held for display and/or storage by apparatus comprising a base and retention means for removably retaining at least one pierced earring on the apparatus, the retention means having an outer layer of sheet plastic material overlaying the base, an inner layer of sheet plastic material interposed between the outer layer of sheet plastic material and the base, a first layer of filler material located between the inner and outer layers of sheet plastic material and maintaining the inner and outer layers in spaced relationship, and a second layer of filler material located between the base and the inner layer of sheet plastic material and maintaining the base and the inner layer in spaced relationship, the inner and outer layers of sheet plastic materialhaving a plurality of holes therethrough with each hole in the inner layer being located in direct axial alignment with a corresponding hole in the outer layer.

BRIEF DESCRIPTION OF THE DRAWINGS

Illustrative embodiments of the inventive concepts are shown in the accompanying drawings in which.

DESCRIPTION OF THE PRESENTLY PREFERRED EMBODIMENTS

Figure 8:
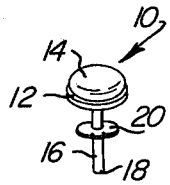
FIG. 8 is a perspective view of an illustrative article suitable for use with the apparatus of the invention.

The apparatus of the invention is particularly adapted for displaying and/or storing earrings for pierced ears, such as the post-type pierced earring 10 shown in detail in FIG. 8, having a body portion comprising a base portion 12 and a decorative portion 14, and at least one relatively small diameter elongated shaft portion 16 extending outwardly from the base portion 12, the end 18 of the shaft portion furthest outward from the base portion being adapted to be retained adjacent the base of the apparatus. The article may additionally comprise conventional clasp member 20 engageable with the shaft portion 16 of the article to retain the article in a desired position in use. Other articles which may be suitably retained on the apparatus will be readily apparent, such as tie tacks, decorative pins, name plates, ensignia pins, military ribbon bars, and other like articles having elongated relatively small diameter shaft portions.

Figure 3:
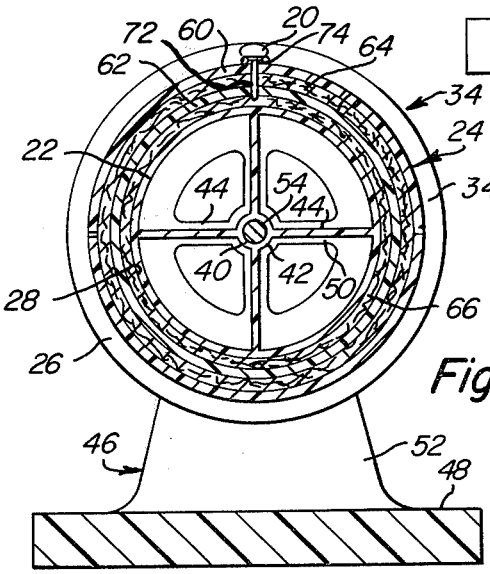
FIG. 3 is a side elevational view in cross section of the apparatus of FIGS. 1 and 2 taken along the line 3—3 in FIG. 2.
Figure 5:
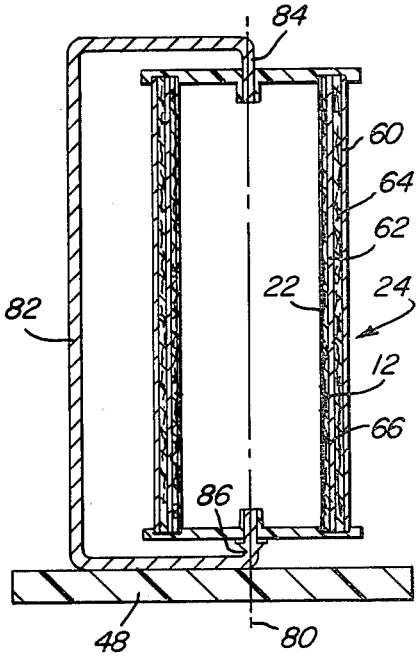
FIG. 5 is a side elevational view of the apparatus of FIG. 4 taken along the line 5—5 in FIG. 4.
Figure 7:
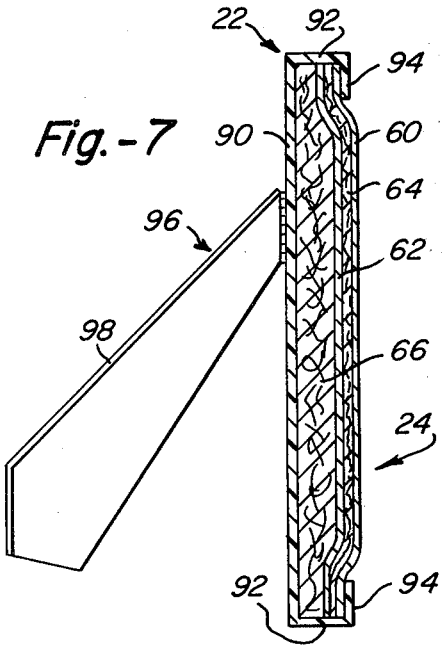
FIG. 7 is a side elevational view of the apparatus of FIG. 6 taken along the line 7—7 of FIG. 6.
Figure 6:
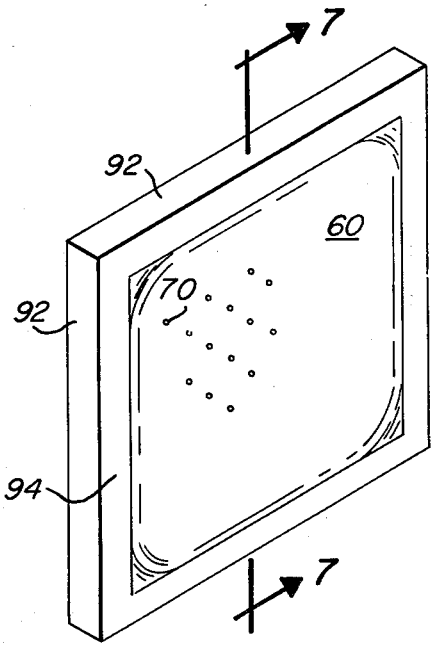
FIG. 6 is a perspective view of an alternate embodiment of the apparatus of FIGS. 1 and 4.

Referring now generally to FIGS. 3, 5 and 7, the apparatus of the invention is generally shown to comprise base 22 and earring retention means 24 on the base 22 for retaining at least one pierced earring, or the like, in removable, fixed relationship with respect to the base.

Figure 1:
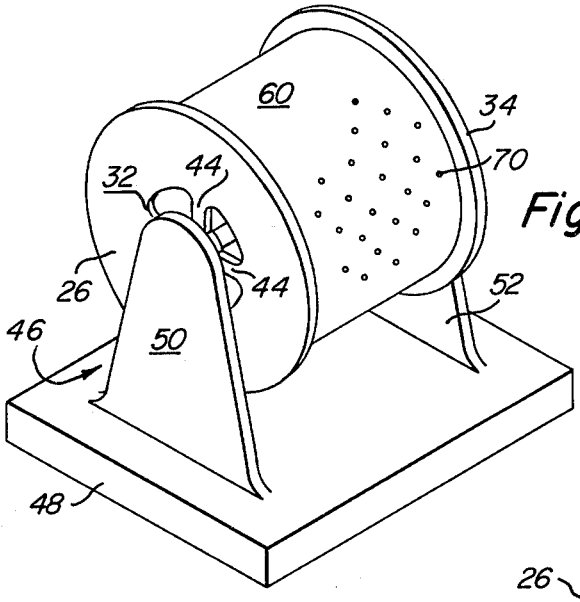
FIG. 1 is a perspective view of one embodiment of the apparatus for holding articles for display or storage.
Figure 2:
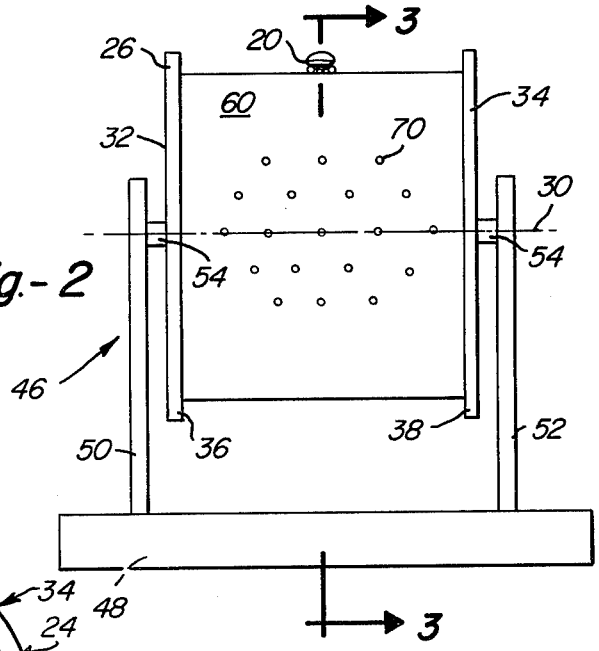
FIG. 2 is an end elevation view of the apparatus of FIG. 1.

In the illustrative embodiment of FIGS. 1–3, the base 22 of the apparatus is shown in the form of a rigid spool member 26 comprising a generally cylindrically shaped, rigid and preferably hollow earring retention means support member 28 having a central axis 30, side portions 32, 34 mounted perpendicularly to central axis 30 at opposite ends of support member 28 and extending radially outward from axis 30 to define flange portions 36, 38, sleeve portion 40 defining axial aperture 42 adapted to receive a cylindrical axle therethrough, and support members 44, for fixedly supporting the sleeve portion 40 in coaxial spaced relationship with support member 28. The apparatus further comprises rotatable support means 46 for rotatably supporting the spool member 26 about its central axis 30, such as base 48, support arms 50, 52, lower portions of which are fixedly mounted on base 48, and generally cylindrical axle 54 mounted on and interconnecting upper portions of the support arms 50, 52, the axle being adapted to be received in and extend through axial aperture 40 of the spool member for rotation of the spool member thereabout.

The earring retention means is shown in FIGS. 1–3 to comprise an outer layer 60 of sheet plastic material overlaying the earring retention means support member 28, an inner layer 62 of sheet plastic material interposed between the outer layer 60 and the support member 28, a first layer 64 of filler material located between the inner and outer layers of sheet plastic material and maintaining the inner and outer layers in spaced relationship with each other, and a second layer 66 of filler material located between the retention means support member 28 and the inner layer 62 of sheet plastic material and maintaining the support member 28 and the inner layer 62 in spaced relationship with each other.

The inner and outer layers 62,60, respectively, of sheet plastic material are preferably formed of a synthetic sheet material having sufficient rigidity to maintain the integrity of the first and second layers 64,66, of filler material while being sufficient resilient and flexible to conform to the shape of base 22. The layers 60,62 are additionally preferably sufficiently thin to be located in spaced relationship, as illustrated in FIG. 3, and allow a portion of the shaft portion 16 of a pierced earring to be received therein and pass therethrough as will be hereinafter further described. Illustrative presently preferred materials for inner and outer layers 62,60 include sheet vinyl plastic and sheet polypropylene plastic having a thickness of about 0.005 to about 0.050 inch and more preferably about 0.010 to about 0.040 inch. The inner and outer layers are preferably tightly drawn about the second and first layers, respectively, of filler material and then integrally seamed in a conventional manner.

The first and second layers 64,66 of filler material may be comprised of any resiliently compressible material capable of receiving the shaft portion 16 of a pierced earring and permitting passage of the shaft portion through the material while preferably providing sufficient frictional resistance against movement of the shaft portion to assist in retaining the earring on the apparatus. Illustrative examples of presently preferred materials for this purpose include continuous materials such as commercially available, regular density polyurethane foam, and fibrous materials such as polyester fiberfill. The combined thickness of the first and second layers of filler material with the inner and outer layers of sheet plastic material is sufficiently great to prevent contact of the end portion 18 of shaft portion 16 with support member 28 when the pierced earring is inserted into the apparatus, as will be hereinafter further described. The outer and inner layers 60,62 of sheet plastic material are provided with a plurality or multiplicity of holes 70 therethrough, preferably sized about the same size as or slightly smaller than the cross-sectional diameter of the shaft portion of an earring to be retained on the apparatus, with each hole through the inner layer of sheet plastic material, such as hole 72, being located in direct axial alignment with a corresponding hole through the outer layer of sheet plastic material, such as hole 74. The entire arrangement is such that the shaft portion of a pierced earring may be inserted through a hole in the outer layer of sheet plastic material, the first layer of filler material, the corresponding hole in the inner layer of sheet plastic material and into the second layer of filler material. After insertion, the pierced earring is retained on the apparatus by frictional forces between the earring shaft and the layers of sheet plastic and filler material.

Figure 4:
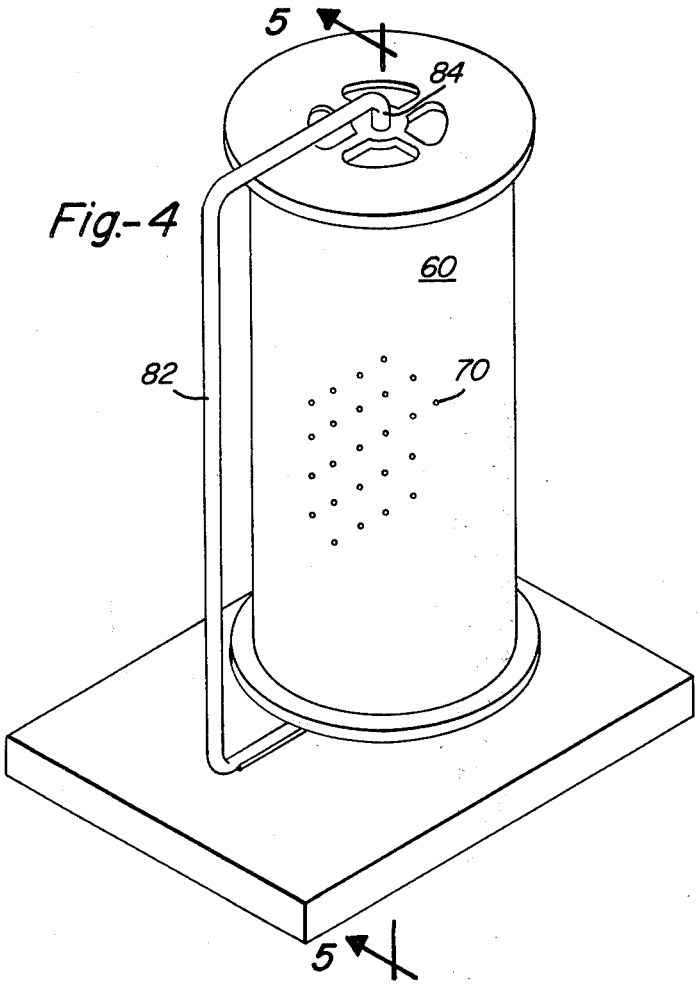
FIG. 4 is a perspective view of an alternate embodiment of the apparatus of FIG. 1.

In the alternate embodiment illustrated in FIGS. 4 and 5, the base 22 is rotatably mounted with its axis 80 in a generally vertical orientation by means of support arm member 82 and pivot members 84,86. In the alternative embodiment illustrated in FIGS. 6 and 7, the base 22 comprises generally flat rigid body portion 90, side wall portions 92 and flange portions 94 defining a structure similar in nature to a conventional picture frame. The apparatus may additionally comprise support means 96, such as pivotably mounted support arm 98, for supporting the apparatus in a generally upright position. In the embodiments of FIGS. 4–7, earring retention means are provided in the same manner and for the same purpose as previously described in association with the embodiment of FIGS. 1–3. It should be readily apparent from the foregoing that the inventive concepts are adapted to being embodied in varying forms, all of which are intended to be included within the scope of the invention.

Figure 9:
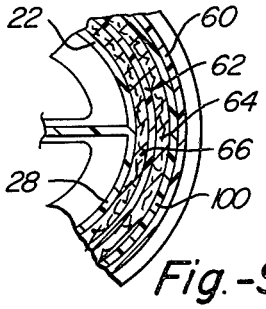
FIG. 9 is a side elevational view in cross-section showing a portion of an alternate embodiment of the apparatus of FIG. 3.

In the alternate embodiment of FIG. 9, the apparatus of the invention additionally comprises an intermediate layer 100 of sheet plastic material interposed between the first layer 64 of filler material and the outer layer 60 of sheet plastic material. The intermediate layer 100 of sheet plastic material is similarly provided with a plurality of multiplicity of holes (not shown) therethrough located in direct axial alignment with the corresponding holes 70 in the inner and outer layers 60, 62, the holes in the intermediate layer 100 being sized slightly smaller than the shaft portion of an earring to be retained on the apparatus. Preferably, the intermediate layer 100 is made of relatively soft, pliable sheet plastic material, such as polypropylene sheet plastic material, adapted to provide additionally gripping forces against the shaft of an earring when the earring is inserted in the apparatus. A presently particularly preferred material for this purpose is 1/32 inch thick Resinol Type O, a polypropylene sheet plastic material manufactured by Allied Resinous Products, Inc., Conneaut, Ohio.

In use of the apparatus as previously described, the shaft 16 of an earring 10 to be retained on the apparatus is manually inserted into the apparatus as previously described, and is thereby held on the apparatus for storage or display. To remove the article, the shaft 16 is simply withdrawn from the layers 60,60,64,66 through the holes 70. In the case of a pierced earring of the type shown in FIG. 8, the conventional clasp member 20 may be positioned on the shaft 16 adjacent the base portion 12 of the earring prior to insertion through an aperture hole 70 for convenient storage of the retention member pending subsequent use.

While the apparatus of the invention has been described in association with various presently preferred embodiments, certain modifications may be apparent. Such modifications are intended to be within the scope of the appended claims, except insofar as precluded by the prior art.

What is claimed is:

1. Apparatus for holding earrings for pierced ears, said earrings having a decorative portion and a shaft portion, the shaft portion being elongated and having a relatively small diameter, generally circular peripheral configuration, the apparatus comprising:

a base; and earring retention means on the base for retaining at least one earring for pierced ears in removable, fixed relationship with respect to the base, the earring retention means comprising, an outer layer of sheet plastic material overlaying the base; an inner layer of sheet plastic material interposed between the outer layer of sheet plastic material and the base; a first layer of filler material located between the inner and outer layers of sheet plastic material and maintaining the inner and outer layers of sheet plastic material in spaced relationship with each other; and a second layer of filler material located between the base and the inner layer of sheet plastic material and maintaining the base and the inner layer of sheet plastic material in spaced relationship with each other; the inner and outer layers of sheet plastic material having a plurality of holes therethrough sized about the same size as, or slightly smaller than, a shaft portion of a pierced earring to be retained on the apparatus, with each hole through the inner layer of sheet plastic material being located in direct axial alignment with a corresponding hole through the outer layer of sheet plastic material, thereby permitting passage of the shaft portion of the pierced earring through a hole in the outer layer of sheet plastic material, the first layer of filler material, the corresponding hole in the inner layer of sheet plastic material and into the second layer of filler material.

2. The apparatus of claim 1 wherein the earring retention means further comprises an intermediate layer of sheet plastic material interposed between the outer layer of sheet plastic material and the first layer of filler material, the intermediate layer of sheet plastic material having a plurality of holes therethrough with each hole in the intermediate layer being located in direct axial alignment with corresponding holes in the inner and outer layers of sheet plastic material.

* * * * *